US006964469B2

(12) United States Patent
Sanada

(10) Patent No.: US 6,964,469 B2
(45) Date of Patent: Nov. 15, 2005

(54) LIQUID DROPLET EJECTION APPARATUS AND INK JET RECORDING HEAD

(75) Inventor: Kazuo Sanada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 6 days.

(21) Appl. No.: 10/255,586

(22) Filed: Sep. 27, 2002

(65) Prior Publication Data

US 2003/0063156 A1 Apr. 3, 2003

(30) Foreign Application Priority Data

Sep. 28, 2001 (JP) ..... 2001-301548

(51) Int. Cl.[7] ..... B41J 2/135
(52) U.S. Cl. ..... 347/46
(58) Field of Search ..... 347/46, 56, 20, 347/65, 67, 61, 63, 94

(56) References Cited

U.S. PATENT DOCUMENTS 5,412,413 A * 5/1995 Sekiya et al. ..... 347/46
5,731,828 A * 3/1998 Ishinaga et al. ..... 347/62
5,980,024 A * 11/1999 Mitani et al. ..... 347/57
6,227,641 B1 * 5/2001 Nishikori et al. ..... 347/17
6,318,842 B1 * 11/2001 Shimomura et al. ..... 347/45
6,341,849 B1 * 1/2002 Misumi ..... 347/65
6,350,016 B1 * 2/2002 Tachihara et al. ..... 347/56
6,467,882 B2 * 10/2002 Inui et al. ..... 347/56

FOREIGN PATENT DOCUMENTS

JP 2001-88334 4/2001

* cited by examiner

*Primary Examiner*—Stephen D. Meier
*Assistant Examiner*—An H. Do
(74) *Attorney, Agent, or Firm*—Whitham, Curtis & Christofferson, PC

(57) ABSTRACT

The liquid droplet ejection apparatus includes a substrate for holding on a surface thereof liquid to be ejected and liquid droplet ejection units provided on the substrate, for pushing the liquid to be ejected by a pushing stroke higher than a height of a liquid surface of the liquid to be ejected held on the substrate. A space existing in a liquid droplet ejecting direction of the liquid droplet ejection units is, substantially, an open space. The inkjet recording head and the thermal inkjet recording head includes the liquid droplet ejection apparatus.

36 Claims, 4 Drawing Sheets

LIQUID DROPLET EJECTION APPARATUS AND INK JET RECORDING HEAD

BACKGROUND OF THE INVENTION

The present invention belongs to the technical field of liquid droplet ejection apparatus utilized for inkjet type recording method and the like and, more particularly, relates to a liquid droplet ejection apparatus of a new structure that does not have any nozzle for ejecting liquid droplets and also to an inkjet recording head utilizing this liquid droplet ejection apparatus.

Thermal inkjet type in which a portion of ink is rapidly vaporized by heating it by the use of a heater, so that, by the expansion force thereof and the like, ink droplets are ejected from nozzles, is utilized in various printers (See JP 48-9622 A, JP 54-51837 A, and the like).

Further, there are also known an electrostatic type and piezoelectric type inkjet printers constituted in such a manner that, by an actuator utilizing static electricity, a piezoelectric element or the like, a diaphragm is vibrated, so that, by the energy thereof, ink droplets, are ejected from nozzles (See JP 11-309850, etc.).

Recently, it is demanded to perform the image recording by such inkjet type more speedily. As for the method of enhancing the speed of image recording by inkjet type, it is important to make improvements in respect of the inkjet recording head such as improvement in the ejection frequency and increase-in the number of nozzles and, at the same time, to shorten the fixing time (drying speed).

Further, it is known that, for shortening the fixing time by raising the fixing speed, the method of reducing the amount of each ink droplet (reduction in size of liquid droplets) and increasing the number of target-hitting liquid droplets per picture element (the smallest unit for expressing images) is effective.

In the inkjet type, the size of the ink droplet is, basically, determined depending on the distance from the ejection unit to the nozzle and the size of the nozzle; and, for reducing the size of the ink droplet extending from the ejection unit to the tip end of the nozzle, the method of reducing the size (the diameter and length) of the nozzle is effective.

However, in case the nozzle diameter is less than 15 $\mu$m, the nozzle tends to get markedly choked up with the ink, as a result of which a stable operation can no longer be obtained. Further, nozzles are normally bored in a plate called an orifice plate (nozzle plate); and the thinning of this orifice plate is also effective for the reduction in size of the ink droplets. However, if the orifice plate is thinned, the orifice plate cannot support itself and thus hangs down, which results in the occurrence of inconveniences such as an insufficient feed of ink caused by the blockade of the ink feed paths due to this orifice plate and the shortage of the ejection pressure due to the fact that the orifice plate is so overwhelmed by the pressure at the time of ejection that it swells. Thus, the orifice plate is required to be thinned under the condition that it secures a sufficient rigidity; at present, it is difficult to reduce the thickness of the orifice plate to less than 10 $\mu$m.

In order to give a solution to such a problem, attempts are being made to reduce the size of ink droplets by the use of an inkjet recording head (hereinafter referred to as recording head) that has no nozzle (nozzle-less).

Known as an example of such nozzle-less recording heads is the so-called ultrasonic wave type recording head that is disclosed in JP 8-290587 A, JP 11-286104 A, and the like).

This recording head is constituted in such a manner that wavelets (capillary waves) are generated on the ejection surfaces (ink surfaces) of the ink droplets by acoustic waves, and the wavelength thereof is utilized as a substantial nozzle diameter, whereby about 10 nL (liters) to 1 pL of ink droplets are ejected. However, in the case of this recording head, the provision of actuators for producing acoustic waves, propagation structures for concentrating the acoustic waves on the ejection surfaces, and the like are necessary; therefore, each ejection mechanism is large, and the power consumption is also large, so that there is a fear that, for example, the realization of a high structural integration for enhancing the recording density may be difficult, though it is possible to render the ink droplets into a minute size.

As another method, there is known a recording head utilizing a minute structure as disclosed in JP 2001-88334 A. This recording head is constituted in such a manner that, in the vicinity of the ejection surface, a minute irregular structure for substantially holding the ink is formed, and this minute structure is provided with the functions to maintain the liquid surface, to cause meniscus growth, to perform ink severance, etc., whereby the ejection of minute ink droplets of a size less than several pL is realized. Even in the case of this recording head, however, there is the fear that the ink nozzles are choked up and the machining is difficult, though it is possible to render the ink droplets into a minute size.

SUMMARY OF THE INVENTION

It is the object of the present invention to solve the above-mentioned technical problem and to provide a liquid droplet ejection apparatus that is utilized in an inkjet recording head, etc. and constituted in such a manner that no nozzle (orifice plate) for ejecting liquid droplets is provided, due to which minute droplets can be ejected, and in addition, no minute structure is required, so that the constitution of the apparatus is simple, and also to provide an inkjet recording head, preferably a thermal inkjet recording head, utilizing this droplet ejection apparatus.

In order to attain the object described above, the present invention provides a liquid droplet ejection apparatus comprising: a substrate for holding on a surface thereof liquid to be ejected; and liquid droplet ejection units provided on the substrate, for pushing the liquid to be ejected by a pushing stroke higher than a height of a liquid surface of the liquid to be ejected held on the substrate, wherein a space existing in a liquid droplet ejecting direction of the liquid droplet ejection units is, substantially, an open space.

Preferably, there is no orifice plate to determine a projection size on the substrate surface of an ejected liquid droplet, and the ejected liquid droplet is formed, in accordance with a dimension of one of the liquid droplet ejection units protruding from the liquid surface of the liquid to be ejected in a direction of the substrate surface, as such that the liquid surface rises and is severed in a projection size of substantively 1.0–1.5 times of the dimension of one of the liquid droplet ejection units in the direction of the substrate surface.

Preferably, a dimension, in a direction of the substrate surface, of one of the liquid droplet ejection units is equal to or less than three times the pushing stroke.

Preferably, stabilizing members for stabilizing the height of the liquid surface are disposed protruding from the substrate surface.

Preferably, each of the liquid droplet ejection units is a heater, and the heater generates a bubble of which a top reaches to a higher position than an initial liquid surface of the liquid to be ejected held on the substrate.

The present invention provides an inkjet recording head having the liquid droplet ejection apparatus described above, wherein the liquid to be ejected is ink and ink droplets are ejected by the liquid droplet ejection apparatus.

The present invention provides a thermal inkjet recording head having the liquid droplet ejection apparatus described above, wherein the liquid to be ejected is ink, each of the liquid droplet ejection units is a heater, the heater generates a bubble of which a top reaches to a higher position than an initial ink surface of the ink held on the substrate and ink droplets are ejected by the liquid droplet ejection apparatus.

DETAILED DESCRIPTION OF THE INVENTION

The liquid ejection apparatus according to the present invention and the inkjet recording head, preferably a thermal inkjet recording head according to the invention that uses this liquid ejection apparatus will now be described in detail on the basis of the preferred embodiments shown in the accompanying drawings.

Figure 1:
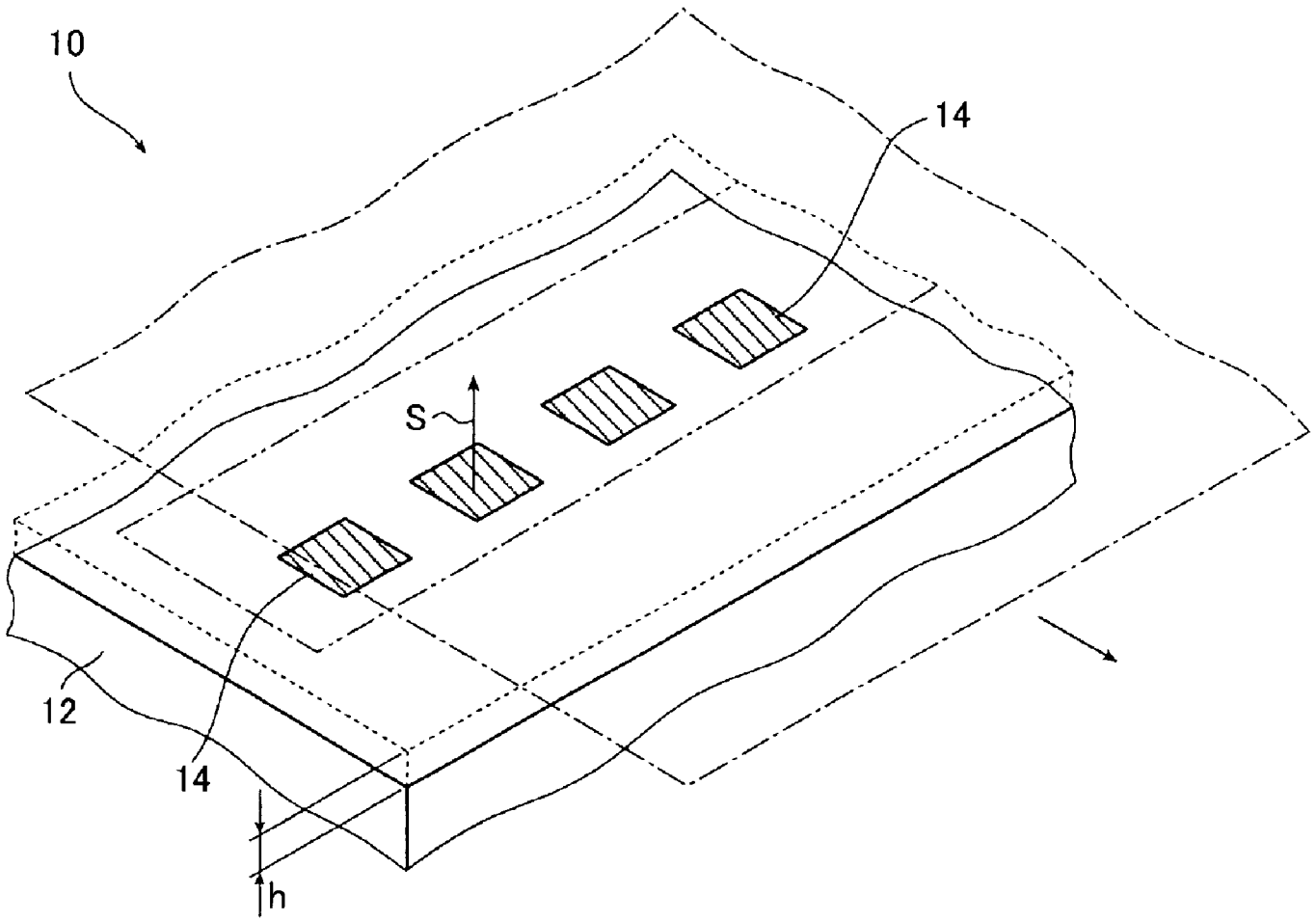
FIG. 1 is a schematic perspective view showing an embodiment of the inkjet recording head according to the present invention.

FIG. 1 is a schematic partial perspective view of an embodiment of the inkjet recording head according to the invention.

The inkjet recording head (hereinafter referred to as recording head) 10 according to the embodiment shown utilizes the droplet ejection apparatus according to the invention and is comprised, basically, of a substrate 12 and heaters 14 formed, as droplet ejection units, on the surface of the substrate 12, which is so-called thermal inkjet recording head. Further, the ink (liquid to be ejected) is held in a liquid film state on the upper surface of the substrate 12 as indicated by a dotted line in FIG. 1.

The recording head 10 is constituted in such a manner that, as in the case of an ordinary thermal inkjet recording head, the heaters 14 are driven to rapidly heat the ink, whereby air bubbles are produced, so that, by the energy of air bubble growth or the explosion energy thereof in addition to the air bubble growth energy, the ink is pushed to eject and fly ink droplets.

Further, the recording head 10 according to the invention has no ink-ejecting nozzle (orifice plate); in other words, the space in the liquid droplet ejecting direction (hereinafter referred to also as the upward direction) of the heaters 14 is, basically, an open space.

Further, in the embodiment shown, such a plurality of heaters 14 are arranged in one direction; this direction corresponds to the so-called nozzle row direction in an ordinary (inkjet) recording head.

Accordingly, recording of an image by the use of this recording head 10 is carried out in such a manner that the ink surface on the substrate 12 is faced to an image-receiving paper (indicated by a one-dot chain line in FIG. 1), and the heaters 14 are modulation-driven in according with the recorded image to eject the ink, while moving the recording head 10 and the image-receiving paper relative to each other in a direction (for example, an arrowed direction in FIG. 1) perpendicular to the direction in which the heaters 14 are arranged.

In the case of the embodiment shown, one row of heaters 14 (droplet ejection units) are provided, but the present invention is not limited to this; for example, two or three or even more rows of heaters 14 may be provided, or the heaters may be arranged two-dimensionally.

Further, the recording head 10 may be constituted in such a manner that one droplet is ejected by one heater 14 or that one droplet is ejected by a plurality of heaters 14.

Moreover, the recording head 10 may be constituted in such a manner that one dot on the image-receiving medium is recorded by one ink droplet or that one dot on the image-receiving medium is recorded by a plurality of ink droplets (sub-dots).

The recording head 10 according to the embodiment shown is formed on a Si wafer by utilizing, for example, the semiconductor manufacturing technology, and the substrate 12 is, for example, a Si substrate.

As shown in FIG. 1, on the surface of such substrate 12, the heaters 14 are formed, and further, in the substrate 12, there are formed an LSI, wirings, etc. for driving the heaters 14.

On the heaters 14, no particular limitation is placed; various types of heaters that are utilized for thermal inkjet can be used as the heaters 14. Preferably, heaters each constituted in such a manner that a ternary alloy consisting of tantalum (Ta), silicon and oxygen is heated in an oxidizing atmosphere to form an insulating film on the surface thereof are exemplified. Further, it is more preferable for the heaters 14 to have a rise speed of $5\times10^8$ K/s or higher. Moreover, as the electrodes (conductor) for feeding energy to the heaters 14, nickel (Ni) is preferable.

A heater utilizing this ternary alloy rises fast and can heat the ink with a small amount of energy yet at high speed. In addition, the above-mentioned insulating film functions as an excellent protective layer, so that the provision of an anti-cavitation layer is not necessary, and the heat efficiency thereof is high. Due to this, by the use of this type of heaters, the temperature rise and heat accumulation of the ink after the ejection thereof and the re-bubbling after the refilling (the refilling of ink after the ejection of ink droplets) can be prevented, and therefore, it is possible to eject the ink droplets at high speed and with high efficiency.

This type of heaters are described in detail in JP 6-71888 A, JP 6-297714 A, JP 7-227967 A, JP 8-20110 A, JP 8-207291 A, JP 10-16242 A, etc.

Further, in the case of the present invention, the ejection units (actuators) for liquid droplets are not limited to the heaters as according to the embodiment shown; in other words, the present invention is not limited to thermal inkjet, but, in the invention, various known droplet ejection units can be utilized.

For example, there may be used ejection units each constituted in such a manner that, by an MEMS (Micro Electronics Machine System) utilizing a piezoelectric element such as a laminated type PZT or the like, a diaphragm is vibrated to eject ink droplets, or there may also be used ultrasonic type ejection units constituted so as to eject ink droplets by-the capillary waves caused by ultrasonic vibrations. Moreover, there may be a static electricity type ejection means utilizing static electricity.

The feed of ink to the heaters 14 (the surface of the substrate 12) may be made from an end portion of the substrate 12, or the ink may be fed from the back surface of the substrate 12 through through-holes bored in the substrate 12.

Further, feed paths for feeding the ink to the heaters 14 may be formed by such a method as forming grooves in the surface of the substrate or as forming walls on the substrate. These feed paths may be provided individually for the heaters or commonly for a plurality of heaters 14, or both ways of providing feed paths may be employed together.

As described above, in the recording head 10 according to the present invention, the ink is held in a liquid film state on the surface of the substrate 12.

Further, no nozzle for ejecting and flying the ink droplets is provided. In other words, the area above the heaters 14 (in the droplet ejecting direction) is, basically, an open space.

Moreover, the pushing stroke S of the heaters 14 for ejecting the ink droplets is larger than the height h of the surface of the ink held on the surface of the substrate 12. Thus, in the case of the embodiment shown, the heaters 14 produce air bubbles higher than the height h.

In the case of a recording head having ordinary nozzles, the size of the ink droplets is basically determined depending on the distance from the ejection units to the nozzles and the size of the nozzles. Further, the ejection of ink droplets is influenced by the surface tension of the ink and the nozzle diameter; by pushing the ink with a force larger than "2T/r (T stands for the surface tension of the ink, and r stands for the radius of the nozzles)", the ink droplets can be severed from the ink and ejected and fly.

On the other hand, studies are being made of nozzle-less recording heads in order to reduce the size of ink droplets, as mentioned above. In the case of such a nozzle-less head, the ejection of ink droplets is influenced, mainly, by the viscosity of the ink. Here, according to the experiments and studies made by the present inventors, even if the viscosity of the ink is high, the ink droplets can be severed from the ink and ejected and fly, by making the ink pushing stroke effected by the ejection units higher than the ink surface.

Figure 2A:
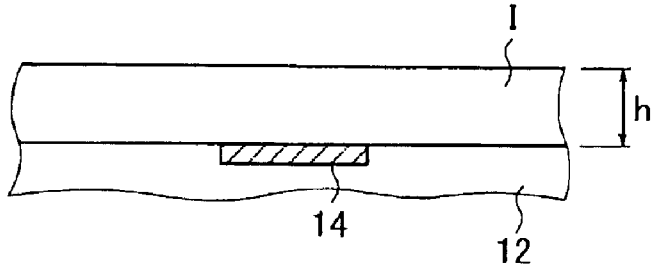
FIGS. 2A to 2D are, respectively, conceptual diagrams for explaining the ejection of an ink droplet from the inkjet recording head shown in FIG. 1.
Figure 2B:
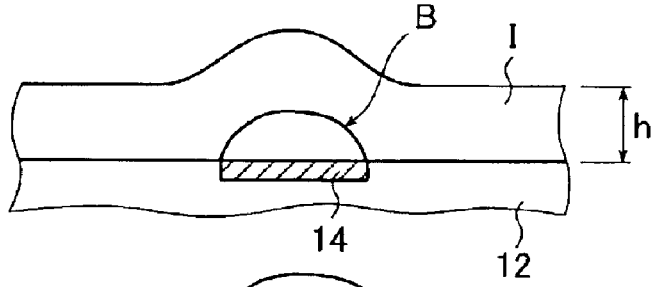
Figure 2C:
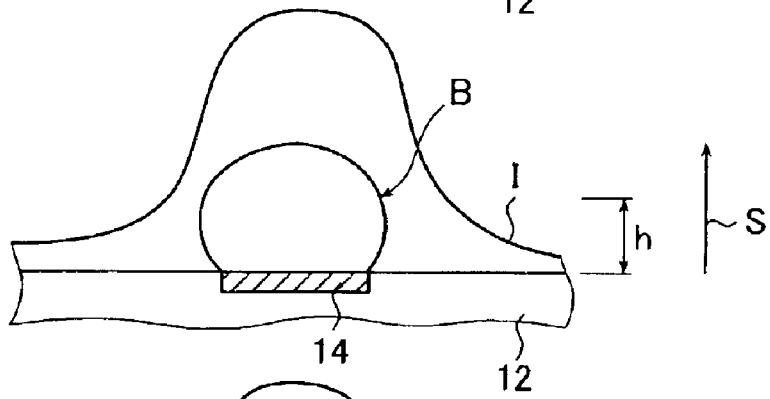
Figure 2D:
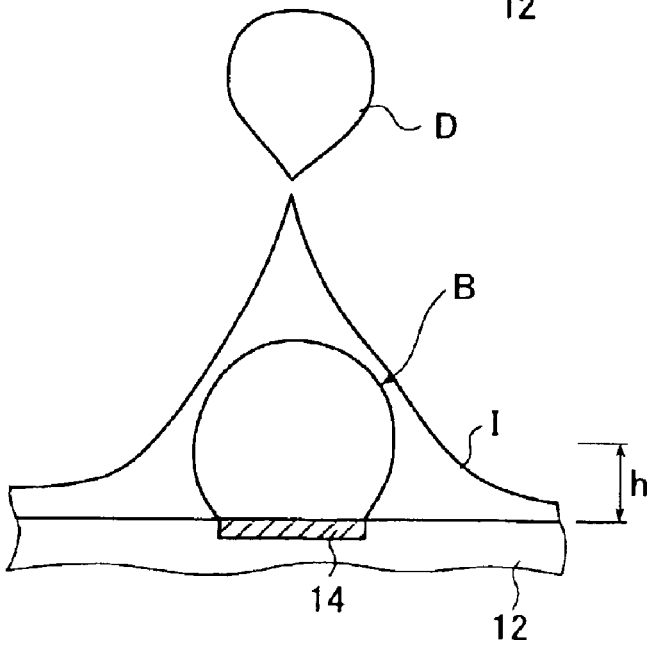

In the recording head 10 according to the present invention, a thin film of an ink I of a height h is formed on the surface of the substrate 12, as shown in FIG. 2A; the heater 14 is driven to produce an air bubble B as shown in FIG. 2B; the pushing stroke S, that is, the size of the air bubble B (the air bubble B being in the positive pressure range) is made larger than the height h of the ink surface, as shown in FIG. 2C, whereby an ink droplet D can be severed from the ink I and ejected as shown in FIG. 2D. In other words, in the present invention, pushing the ink as an ejection liquid with a pushing stroke higher than the height of the liquid surface is that a top of the bubble reaches to a higher position than the initial surface of the ink-as the ejection liquid in the case of the thermal inkjet type.

Figure 3:
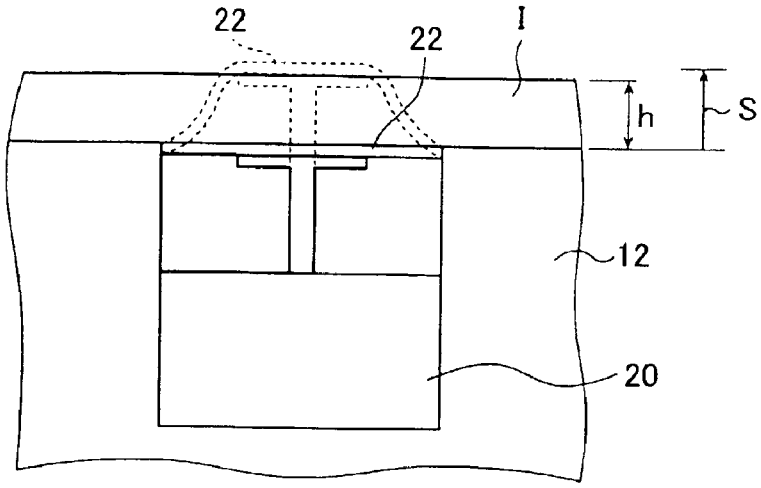
FIG. 3 is a schematic partial cross-sectional view conceptually showing another embodiment of the inkjet recording head according to the invention.

Or, as shown in FIG. 3, in the case of an inkjet using an ejection unit that ejects an ink droplet by vibrating a diaphragm by utilizing an MEMS, the height (pushing stroke S) of a diaphragm 22 vibrated by the MEMS 20 is made higher than the height h of the liquid surface, whereby ink droplets can be likewise ejected.

Since the present invention has such a constitution, it is made possible to eject minute ink droplets by the use of a simple construction in which no nozzle is used, and no minute structure is required. Further, the ejection surface directly communicates with the feed path of ink, so that the speed for refilling is high, and thus, a high-speed ink ejection can be executed. Further, there is no fear of the ink feed path being choked up.

In the recording head 10 according to the present invention, the height h of the ink surface may suitably be determined in accordance with the desired size of the ink droplet, the ejection unit used, whether or not the ink can be held on the substrate 12 in accordance with the surface tension of the ink and the like.

Generally speaking, the size of air bubbles (within the positive pressure range) is about 5 $\mu$m to 10 $\mu$m in the case of thermal inkjet, the pushing stroke S is about several $\mu$m in the case of an ejection unit using an MEMS that utilizes a laminated type PZT or static electricity, and the pushing stroke S is 1 $\mu$m or less in the case of an ejection unit that uses ultrasonic waves; and therefore, the height of the liquid surface may be set so as to become less than the respective pushing strokes by taking these values into account.

In the case of thermal inkjet, the air bubbles grow further, exceeding the positive pressure range, but the growth of bubbles exceeding the positive pressure range functions very little as the energy for pushing the ink and ejecting the liquid droplets. Therefore, in case the present invention is utilized for a thermal inkjet as according to the embodiment shown, the pushing stroke S is set within the positive pressure range pertaining to the growth of air bubbles.

Figure 4:
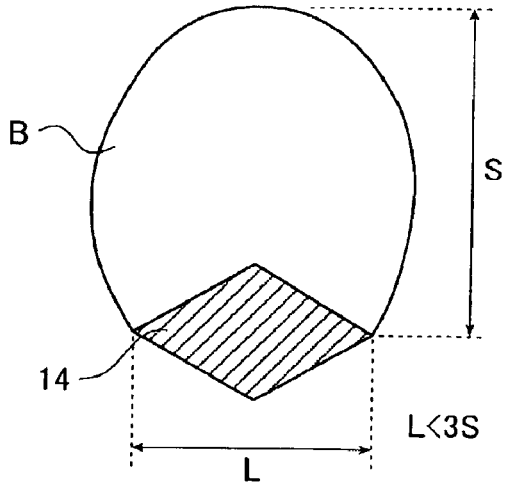
FIG. 4 is a schematic perspective view for explaining the inkjet recording head according to the invention.

In the recording head 10 according to the present invention, no particular limitation is placed on the size of the heater 14, but, in case the maximum length of the heater 14 is designated as L (hereinafter referred to as size L) as shown in FIG. 4, it is desirable to set the maximum length to a value that satisfies "$L \leqq 3*S$".

In the case of a thermal inkjet as according to the embodiment shown, if the pushing stroke S based on the air bubble B is larger than the height h of the liquid surface, the ink droplet can be ejected no matter what the size L of the heater 14 is. In the case of the present invention, however, the larger the size L of the heater 14 is, the flatter the formed air bubble becomes, as a result of which there occurs the fear that the shape of the ink droplet when the ink droplet hits upon the image-receiving medium may not be stabilized.

On the other hand, in the case of an inkjet formed in such a manner that, by the use of a piezo-element, an MEMS or the like, the ink is pushed to move by a diaphragm, it is necessary to separate the ink from the surface of the diaphragm, in which case the surface tension of the ink disturbs the ejection of an ink droplet. If the pushing stroke S is larger than the height h of the liquid surface, therefore, the ejection of the ink droplet can be made, but, the larger the size L of the ejection unit is, the more difficult the stable and good ejection as well as flight of the ink droplet become, due to the surface tension of the ink.

In connection with this, the experiments, simulations, etc. made by the present inventors reveal that, if the size L of the heater 14 satisfies "$L \leqq 3*S$" or "$L<3*S$", then, in the case of a thermal inkjet, the shape of the ink droplet when it hits upon the image-receiving medium can be sufficiently stabilized, or, in the case of an inkjet using a diaphragm, the separation of the ink from the diaphragm can be achieved infallibly; in other words, the proper ejection of an ink droplet can be stably executed.

Further, no particular limitation is made, either, on the ink pushing speed (the speed of bubble growth in the ejecting direction and the vibration speed of the diaphragm), but, basically, the higher the ink pushing speed is, the more desirable the result is.

Here, in case it is assumed that the pushing speed is represented as v [m/s], the flight of the ink droplet is influenced within the range-of about "$(\mu h/(\rho v))^{0.5}$" from the end portion of the heater 14 or an actuator such as a diaphragm, due to the viscosity of its own. In this expression, h stands for the height "m" of the ink surface, and $\mu$ stands for the viscosity [Pa·s] of the ink, and p stands for the density [kg/m$^3$] of the ink, as already mentioned.

In this case, the spread angle of the ink droplet ejection from the end portion of an actuator such as the heater 14 is expressed as follows:

$$\tan\theta=((\mu h/(\rho v)^{0.5})/h=(\mu/(\rho v h))^{0.5}.$$

In order to concentrate the ejection energy, the above-indicated value should desirably be small; according to the study made by the present inventors, this value should desirably be about 0.2 or less, accordingly, $$\tan\theta=(\mu/(\rho v h))^{05}\leqq 0.2.$$

Thus, in case the pushing speed v satisfies the following expression, a good ejection performance can be stably obtained:

$$v\geqq 25\ \mu/(\rho h).$$

Through the experiments made by the present inventors, a good ejection performance was obtained by the use of an ink of which the viscosity $\mu$ was 2 cP to 20 cP and the density ρ was about 1 g/cc, in case the height h of the ink surface was set to 5 $\mu$m, and a thermal inkjet in which a pushing speed of v≧25 m/s was realized in the vicinity of the above-mentioned height h of the ink surface was used.

Further, in case an ejection unit constituted in such a manner that a diaphragm is vibrated by the use of a piezo-element and the pushing stroke S thereof is 4 $\mu$m was used and the height h of the ink surface was set to 2.5 $\mu$m, a good ejection performance was obtained, with an ink of which the viscosity $\mu$ was 2 cP and the density ρ was about 1 g/cc, when the pushing speed v (actuator speed) exceeded 20 m/s.

From this point, it can be understood that, in case the ink pushing speed v satisfies the above-indicated expression, a good ejection performance can be stably obtained.

Furthermore, as apparent from above, in the present invention, the so-called nozzleless type that includes no orifice plate to determine a projection size of the ejected droplet on the substrate surface is utilized, so that the ink droplet to be ejected is formed in such a manner that the liquid surface of the ink rises and is severed according to the dimension of an actuator such as the heater 14 protruding from the liquid surface of the ink as the ejection liquid in the direction of the substrate surface.

Accordingly, the ratio of the projection area of the ink droplet to the dimension of an actuator such as the heater 14 is determined using the above-indicated expression as:

$$1.0\leqq(1+\tan\theta)^2\leqq 1.2^2=1.44\leqq 1.5.$$

Therefore, the projection size of the ink droplet is about 1.44 times, and it is desirable that the ink droplet is substantively equivalent to, or about 1.5 times or less, that is, 1.0–1.5 times of the dimension of an actuator such as the heater 14 in the direction of the substrate surface.

Figure 5:
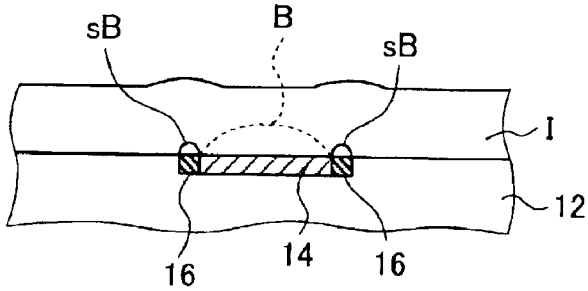
FIG. 5 is a schematic partial cross-sectional view conceptually showing still another embodiment of the inkjet recording head according to the invention.

The recording head 10 according to the present invention may alternatively be constituted, as required, in such a manner that, in order to better ensure the severance of the ink portion on the heater 14 from the ink existing therearound, sub-heaters 16 are provided to surround the heater 14 as shown in FIG. 5, so that, prior to the production of an air bubble B, small air bubbles sB are produced by the sub-heaters 16, whereby, before driving the heater 14, the ink portion on the heater 14 and the ink therearound are brought into a state somewhat severed from each other.

Further, it is also permissible to apply a water repellant treatment to the surface portion of the substrate 12 around the heater 14, whereby the severance of the ink and the ejection of the droplet can be facilitated.

In the recording head 10 according to the present invention, holding of the ink on the surface of the substrate 12 may be made by utilizing only the surface tension of the ink, but it is preferable to provide a stabilizing member protruding from the surface of the substrate 12 in order to better assure the holding of the ink and stabilize the height of the ink surface.

On the shape and constitution of the stabilizing member, no particular limitation is placed; various types of stabilizing members are usable.

Figure 6A:
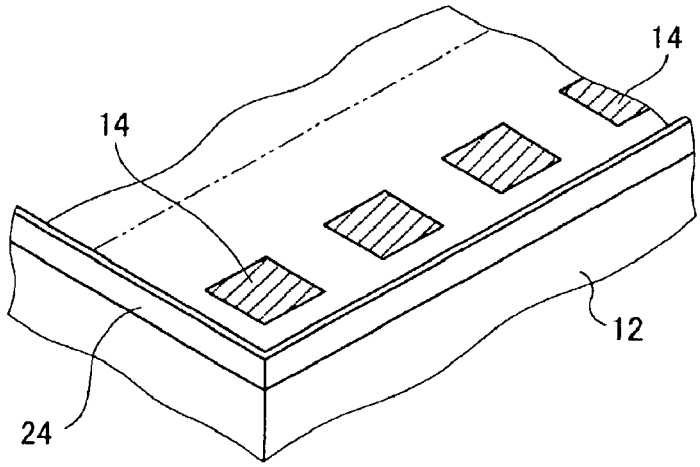
FIGS. 6A to 6D are, respectively, schematic perspective views of still other embodiments of the inkjet recording head according to the invention.
Figure 6B:
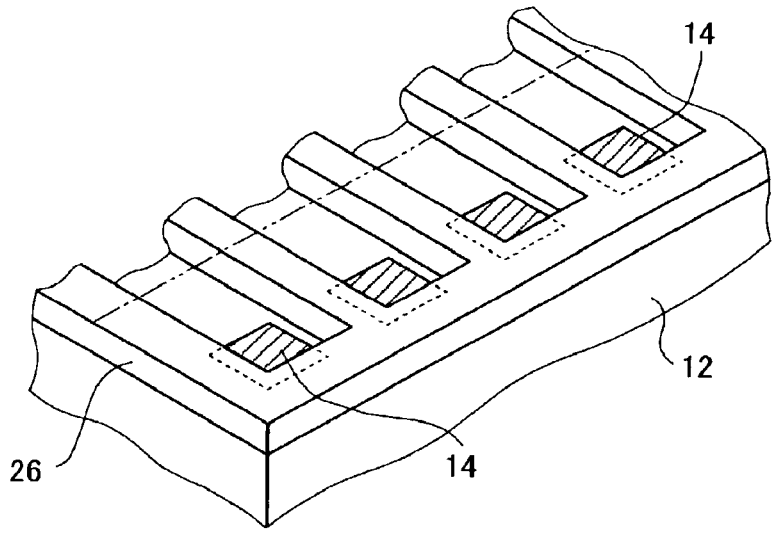

As ah example, a wall-shaped stabilizing member 24 that is formed like a bank surrounding the substrate 12 is given as shown in FIG. 6A. Further, as shown in FIG. 6B, a stabilizing member 26 constituted so as to form, therein, ink flow paths to the individual heaters 14 is also suitable. This structure shown in FIG. 6B can also be realized in the form of the structure resulting from removing the orifice plate from an ordinary recording head of the so-called top shooter type (face inkjet) which ejects ink droplets in the direction perpendicular to the surface of the substrate.

Figure 6C:
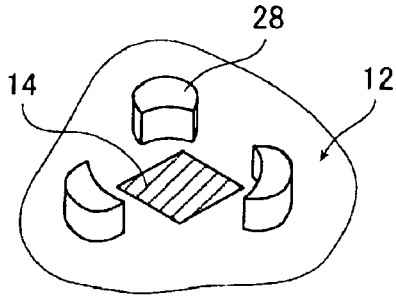

Further, besides such wall-shaped stabilizing members, pillar-shaped stabilizing members 28, which are disposed so as to surround the heater 14 as shown in FIG. 6C, are also suitable. Further, such pillar-shaped stabilizing members 28 may alternatively be disposed so as to surround a plurality of heaters 14 as shown in FIG. 6D.

Figure 6D:
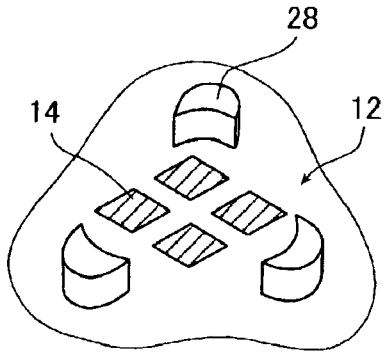

Here, in the present invention, it is desirable to set the intervals between the stabilizing members to two or more times the size L of the heaters 14, as shown in FIG. 6A and FIG. 6D.

By so doing, it becomes possible to eject minute ink droplets without forming any minute structure, which proves to be advantageous in respect of the elongation of the line head, the speed of refilling, the prevention of the ink paths from being choked up, etc.

Here, it is pointed out that, if, at the time of refilling ink after the ejection of an ink droplet, the ink portions that flow onto the heater 14 collide with each other (head-on collision) on a straight line, then the ink undulates due to the swelling of the ink surface at the time of collision or the like, and thus, the refilling time becomes long.

Therefore, it is desirable to dispose the stabilizing members, so as to avoid the occurrence of such a head-on collision, in the large flows of the ink to be refilled. For example, in the case of the embodiments shown in FIG. 6C and FIG. 6D, the large flows of ink at the time of refilling thereof head for the center of the stabilizing members 28, passing between the three stabilizing members 28; in other words, the flows of the ink to be refilled collide against one another at the center of the stabilizing members 28, with an angle of 120° between the respective ink flows. In the case of this structure, the reaction from the undulation caused by the collision of the ink flows can be effectively absorbed by the stabilizing members 28 to shorten the refilling time.

Further, it is also permissible to provide these stabilizing members with a function of preventing their interference with the adjacent heaters 14.

In the recording head 10 according to the present invention, it is desirable to provide a sealing member for blockading the upper surface of the substrate 12 in the region other than the region above the heaters 14 (ejection units) in order to prevent the ink from leaking out of the head. Further, it is also advisable to constitute the recording head so as to hold, by this sealing member, the sealing liquid used at the time of shipping.

The sealing member may be formed of various types of plates. As an example, a plate-shaped sealing member that has an opening indicated by a two-dot chain line in FIG. 1 and blockades the whole upper surface of the substrate 12 is given. Further, in the case of the structure shown in FIG. 6A or FIG. 6B, there can be used, for example, a plate-shaped sealing member constituted in such a manner that the portion thereof which lies at the right-hand side with respect to the two-dot chain line shown is made open, and thus, the upper surface of the left-hand side portion, with respect to the two-dot chain line, of the substrate 12 is blockaded. In this case, such opening is not necessarily one in number in association with all the heaters 14, but the sealing member may have a plurality of such openings if the spaces above all the heaters 14 are made into open spaces thereby.

Further, the studies made by the present inventor reveal that, in order to prevent the leakage of an ordinary ink more suitably in the state in which the ink is held upside down under a negative pressure, the size of one opening (the open region above the substrate 12) in the sealing member should desirably be set to less than 200 $\mu$m. This opening size of less than 200 $\mu$m is a value determined by taking into account also the blockade of the opening in the sealing member by the stabilizing members.

Further, it is a matter of course that, in the case of the present invention that uses no nozzle, the sealing member is not an orifice plate, so that the size of the opening is larger than the size L of the heaters 14. Further, as mentioned above, the intervals between the holding members are desirably set to two or more times this size L.

Taking the above-mentioned points into account, the recording head 10 according to the present invention should desirably be of a constitution satisfying the following condition:

200 $\mu$m>the size of the opening in the sealing member>the interval between the holding members>the size L.

Further, the so-called capping of the recording head, 10 according to the present invention during a waiting period or while in custody may be performed so as to blockade the opening portion of the sealing member, and further, the cleaning may be performed before and after a recording operation or at the time of starting, stopping, etc. to the opening portion of the sealing member, the holding member, etc.

In the above, the liquid droplet ejection apparatus and the inkjet recording, head, preferably a thermal inkjet recording head, according to the present invention have been described in detail; however, the invention is not limited to the foregoing embodiments, but it is a matter of course that various improvements or modifications may be made without departure from the technical scope of the invention.

For example, the foregoing embodiments relate to the application of the droplet ejection apparatus according to the invention to inkjet recording heads, but the invention is not limited to these embodiments but applicable to various types of droplet ejection apparatus; that is, the invention is, also, suitably utilizable in apparatus, other than the inkjet recording head, such as an apparatus for applying a bonding agent in minute patterns.

As has been described in detail above, according to the present invention, there is provided a novel liquid droplet ejection apparatus that can eject minute liquid droplets without the use of ink-ejecting nozzles (orifice plate) and can efficiently prevent the ink paths from being choked up with ink or the like, by the use of a simple constitution in which no minute structure is required, and also, a novel inkjet recording head, preferably a novel thermal inkjet recording head, utilizing this droplet ejection apparatus is provided.

What is claimed is:

1. A liquid droplet ejection apparatus comprising:

a substrate for holding on a surface thereof liquid to be ejected; and liquid droplet ejection units provided on the substrate, for pushing the liquid to be ejected by a pushing stroke higher than a height of a liquid surface of said liquid to be ejected held on the substrate, wherein there is no orifice plate to determine a projection size on the substrate surface of an ejected liquid droplet, wherein said ejected liquid droplet is formed, in accordance with a dimension of one of said liquid droplet ejection units protruding from the liquid surface of said liquid to be ejected in a direction of the substrate surface, such that said liquid surface rises and is severed in a projection size of substantially 1.0–1.5 times the dimension of said liquid droplet ejection units in the direction of the substrate surface, and wherein a space existing in a liquid droplet ejecting direction of said liquid droplet ejection units is, substantially, an open space.

2. The liquid droplet ejection apparatus according to claim 1, wherein a dimension, in a direction of the substrate surface, of said liquid droplet ejection units is equal to or less than three times said pushing stroke.

3. The liquid droplet ejection apparatus according to claim 1, wherein a pushing speed v is provided to the ejected liquid droplets such that $v>=25\ \mu/(\rho h)$, where $\mu$ is the viscosity of the liquid, $\rho$ is the density of the liquid, and h is the height of the liquid surface.

4. The liquid droplet ejection apparatus according to claim 1, wherein stabilizing members for stabilizing said height of the liquid surface are disposed protruding from said substrate surface.

5. The liquid droplet ejection apparatus according to claim 1, wherein each of said liquid droplet ejection units is a heater, and said heater generates a bubble of which a top reaches to a higher position than an initial liquid surface of said liquid to be ejected held on the substrate.

6. The liquid droplet ejection apparatus according to claim 5, wherein said height of the liquid surface of said liquid is determined in accordance with a size of said liquid droplet to be ejected, wherein said pushing stroke is a size of said bubble and ranges from 5 $\mu$m to 10 $\mu$m.

7. The liquid droplet ejection apparatus according to claim 5, wherein said height of the liquid surface of said liquid is determined in accordance with said liquid droplet ejection units, wherein the pushing stroke is a size of said bubble and ranges from 5 $\mu$m to 10 $\mu$m.

8. The liquid droplet ejection apparatus according to claim 5, wherein said height of the liquid surface of said liquid is determined in accordance with whether or not said liquid can be held on said substrate in accordance with the surface tension of said liquid, wherein said pushing stroke is a size of said bubble and ranges from 5 μm to 10 μm.

9. The liquid droplet ejection apparatus according to claim 1, wherein said height of the liquid surface of said liquid is determined in accordance with a size of said liquid droplet, wherein said liquid droplet unit uses micro electronics machine system and the pushing stroke is several μm.

10. The liquid droplet ejection apparatus according to claim 1, wherein said height of the liquid surface is determined in accordance with a size of said liquid droplet, wherein each of said liquid droplet units uses ultrasonic waves and the pushing stroke is 1 μm or less.

11. The liquid droplet ejection apparatus according to claim 1, wherein said height of the liquid surface of said liquid is determined in accordance with said liquid droplet ejection units, wherein each of said liquid droplet units uses a micro electronics machine system and the pushing stroke is several μm.

12. The liquid droplet ejection apparatus according to claim 1, wherein said height of the liquid surface of said liquid is determined in accordance with said liquid droplet ejection units, wherein each of said liquid droplet units uses ultrasonic waves and the pushing stroke is 1 μm or less.

13. The liquid droplet ejection apparatus according to claim 1, wherein said height of the liquid surface of said liquid is determined in accordance with whether or not said liquid can be held on said substrate in accordance with the surface tension of said liquid, wherein each of said liquid droplet units uses micro electronics machine system and the pushing stroke is several μm.

14. The liquid droplet ejection apparatus according to claim 1, wherein said height of the liquid surface of said liquid is determined in according with whether or not said liquid can be held on said substrate in accordance with the surface tension of said liquid, wherein each of said liquid droplet units uses ultrasonic waves and the pushing stroke is 1 μm or less.

15. An inkjet recording head having a liquid droplet ejection apparatus comprising:

a substrate for holding on a surface thereof liquid to be ejected; and liquid droplet ejection units provided on the substrate, for pushing the liquid to be ejected by a pushing stroke higher than a height of a liquid surface of said liquid to be ejected held on the substrate, wherein there is no orifice plate to determine a projection size on the substrate surface of a liquid droplet, wherein said liquid droplet is formed, in accordance with a dimension of one of said liquid droplet ejection units protruding from the surface of said liquid in a direction of the substrate surface, such that said liquid surface rises and is severed in a projection size of substantially 1.0–1.5 times the dimension of said liquid droplet ejection units in the direction of the substrate surface, and wherein a space existing in a liquid droplet ejecting direction of said liquid droplet ejection units is, substantially, an open space, and wherein said liquid to be ejected is ink and ink droplets are ejected by said liquid droplet ejection units.

16. The inkjet recording head according to claim 15, wherein a dimension, in a direction of the substrate surface, of said liquid droplet ejection units is equal to or less than three times said pushing stroke.

17. The inkjet recording head according to claim 15, wherein a pushing speed v is provided to the ejected ink droplets such that $v>=25\ \mu/(\rho h)$, where $\mu$ is the viscosity of the ink, $\rho$ is the density of the ink, and h is the height of the ink surface.

18. The inkjet recording head according to claim 15, wherein stabilizing members for stabilizing said height of the ink surface are disposed protruding from said substrate surface.

19. The inkjet recording head according to claim 15, wherein each of said liquid droplet ejection units is a heater, and said heater generates a bubble of which a top reaches to a higher position than an initial liquid surface of said liquid to be ejected held on the substrate, wherein said height of the liquid surface of said liquid is determined in accordance with a size of said liquid droplet to be ejected, wherein said pushing stroke is a size of said bubble and ranges from 5 μm to 10 μm.

20. The inkjet recording head according to claim 15, wherein said height of the liquid surface of said liquid is determined in accordance with a size of said liquid droplet, wherein said liquid droplet unit uses micro electronics machine system and the pushing stroke is several μm.

21. The inkjet recording head according to claim 15, wherein said height of the liquid surface of said liquid is determined in accordance with a size of said liquid droplet, wherein each of said liquid droplet units uses ultrasonic waves and the pushing stroke is 1 μm or less.

22. The inkjet recording head according to claim 15, wherein each of said liquid droplet ejection units is a heater, and said heater generates a bubble of which a top reaches to a higher position than an initial liquid surface of said liquid to be ejected held on the substrate, wherein said height of the liquid surface of said liquid is determined in accordance with said liquid droplet ejection units, wherein the pushing stroke is a size of said bubble and ranges from 5 μm to 10 μm.

23. The inkjet recording head according to claim 15, wherein said height of the liquid surface of said liquid is determined in accordance with said liquid droplet ejection units, wherein each of said liquid droplet units uses a micro electronics machine system and the pushing stroke is several μm.

24. The inkjet recording head according to claim 15, wherein each of said liquid droplet ejection units is a heater, and said heater generates a bubble of which a tope reaches to a higher position than an initial liquid surface of said liquid to be ejected held on the substrate, wherein said height of the liquid surface of said liquid is determined in accordance with said liquid droplet ejection units, wherein each of said liquid droplet units uses ultrasonic waves, and the pushing stroke is 1 μm or less.

25. The inkjet recording head according to claim 15, wherein said height of the liquid surface of said liquid is determined in accordance with whether or not said liquid can be held on said substrate in accordance with the surface tension of said liquid, wherein said pushing stroke is a size of said bubble and ranges from 5 μm to 10 μm.

26. The inkjet recording head according to claim 15, wherein said height of the liquid surface of said liquid is determined in accordance with whether or not said liquid can be held on said substrate in accordance with the surface tension of said liquid, wherein each of said liquid droplet units uses micro electronics machine system and the pushing stroke is several μm.

27. The inkjet recording head according to claim 15, wherein said height of the liquid surface of said liquid is determined in accordance with whether or not said liquid can be held on said substrate in accordance with the surface tension of said liquid, wherein each of said liquid droplet units uses ultrasonic waves and the pushing stroke is 1 μm or less.

28. A thermal inkjet recording head having a liquid droplet ejection apparatus comprising:

a substrate for holding on a surface thereof liquid to be ejected; and liquid droplet ejection units provided on the substrate, for pushing the liquid to be ejected by a pushing stroke higher than a height of a liquid surface of said liquid to be ejected held on the substrate, wherein there is no orifice plate to determine a projection size on the substrate surface of a liquid droplet, wherein said liquid droplet is formed, in accordance with a dimension of said heater protruding from the surface of said liquid in a direction of the substrate surface, such that said liquid surface rises and is severed in a projection size of substantively 1.0–1.5 times the dimension of said heater in the direction of the substrate surface, wherein a space existing in a liquid droplet ejecting direction of said liquid droplet ejection units is, substantially, an open space, and wherein said liquid to be ejected is ink, each of said liquid droplet ejection units is a heater, said heater generates a bubble of which a top reaches to a higher position than an initial ink surface of said ink held on the substrate and ink droplets are ejected by said liquid droplet ejection units.

29. The thermal inkjet recording head according to claim 28, wherein a dimension, in a direction of the substrate surface, of said liquid droplet ejection units is equal to or less than three times said pushing stroke.

30. The thermal inkjet recording head according to claim 28, wherein a pushing speed $v$ is provided to the ejected ink droplets such that $v>=25\ \mu/(\rho h)$, where $\mu$ is the viscosity of the ink, $\rho$ is the density of the ink, and h is the height of the ink surface.

31. The thermal inkjet recording head according to claim 28, wherein stabilizing members for stabilizing said height of the ink surface are disposed protruding from said substrate surface.

32. The thermal inkjet recording head according to claim 28, wherein sub-heaters are provided to surround the heater so that small air bubbles are produced by the sub-heaters prior to driving the heater.

33. The thermal inkjet recording head according to claim 28, wherein a water repellant treatment is applied to the surface portion of the substrate around the heater.

34. The thermal inkjet recording head according to claim 28, wherein said height of the liquid surface of said liquid is determined in accordance with a size of said liquid droplet to be ejected, wherein said pushing stroke is a size of said bubble and ranges from 5 μm to 10 μm.

35. The thermal inkjet recording head according to claim 28, wherein said height of the liquid surface of said liquid is determined in accordance with said liquid droplet ejection units, wherein the pushing stroke is a size of said bubble and ranges from 5 μm to 10 μm.

36. The thermal inkjet recording head according to claim 28, wherein said height of the liquid surface of said liquid is determined in accordance with whether or not said liquid can be held on said substrate in accordance with the surface tension of said liquid, wherein said pushing stroke is a size of said bubble and ranges from 5 μm to 10 μm.

* * * * *